US005842910A

United States Patent [19]

Krywanczyk et al.

[11] Patent Number: 5,842,910

[45] Date of Patent: Dec. 1, 1998

[54] OFF-CENTER GROOVED POLISH PAD FOR CMP

[75] Inventors: Timothy Charles Krywanczyk; Douglas Keith Sturtevant; Matthew Thomas Tiersch, all of Essex Junction, Vt.

[73] Assignee: International Business Machines Corporation, Armonk, N.Y.

[21] Appl. No.: 812,884

[22] Filed: Mar. 10, 1997

[51] Int. Cl.[6] ..... B24B 1/00

[52] U.S. Cl. ..... 451/41; 451/57; 451/285

[58] Field of Search ..... 451/41, 57, 58, 451/59, 538, 539, 548, 550, 461, 278, 270, 285, 287

[56] References Cited

U.S. PATENT DOCUMENTS

| | | | |
|---|---|---|---|
| 2,309,016 | 1/1943 | Ryan . | |
| 2,451,295 | 10/1948 | Metzger et al. . | |
| 3,841,031 | 10/1974 | Walsh . | |
| 5,297,364 | 3/1994 | Tuttle | 451/527 |
| 5,329,734 | 7/1994 | Yu . | |
| 5,421,769 | 6/1995 | Schultz et al. . | |
| 5,441,598 | 8/1995 | Yu et al. . | |
| 5,503,592 | 4/1996 | Neumann | 451/41 |
| 5,534,106 | 7/1996 | Cote et al. . | |
| 5,558,563 | 9/1996 | Cote et al. . | |
| 5,605,490 | 2/1997 | Laffey et al. | 451/36 |

FOREIGN PATENT DOCUMENTS

| | | | |
|---|---|---|---|
| 361226272 | 10/1986 | Japan . | |
| 602357 | 4/1978 | U.S.S.R. | 451/270 |
| 939361 | 12/1958 | United Kingdom . | |

*Primary Examiner*—Timothy V. Eley
*Assistant Examiner*—Derris H. Banks
*Attorney, Agent, or Firm*—Schmeiser, Olsen & Watts; Howard J. Walter, Jr.

[57] ABSTRACT

A method and apparatus for polishing a semiconductor wafer using a polishing pad. The polishing pad contains circumferential grooves which are located off center from the geometric center of the polishing pad.

12 Claims, 1 Drawing Sheet

OFF-CENTER GROOVED POLISH PAD FOR CMP

FIELD OF THE INVENTION

The invention is generally related to chemical-mechanical polish (CMP) operations performed during integrated circuit manufacturing, and particularly to polishing semiconductor wafers and chips which include integrated circuits. The invention is specifically related to polishing pad construction and operations that allow for improved control of polishing.

BACKGROUND OF THE INVENTION

Rapid progress in semiconductor device integration demands smaller and smaller wiring patterns or interconnections which connect active areas. As a result, the tolerances regarding the planeness or flatness of the semiconductor wafers used in these processes are becoming smaller and smaller. One customary way of flattening the surfaces of semiconductor wafers is to polish them with a polishing apparatus.

Such a polishing apparatus has a rotating wafer carrier assembly in contact with a polishing pad. The polishing pad is mounted on a rotating turntable which is driven by an external driving force. The polishing apparatus causes a polishing or rubbing movement between the surface of each thin semiconductor wafer and the polishing pad while dispersing a polishing slurry to obtain a chemical mechanical polish (CMP). CMP in planarization requires the wafer surface to be brought into contact with a rotating pad saturated with either a slurry of abrasive particles or a reactive solution, or both, that attacks the wafer surface. This is done while exerting force between the wafer and polishing pad.

Generally, CMP does not uniformly polish a substrate surface and material removal proceeds unevenly. For example, it is common during oxide polishing for the edges of the wafer to be polished slower than the center of the wafer. There exists a need for a method and device for controlling the removal of material from substrate surface such as semiconductor wafers and/or chips such that a uniform surface across the substrate can be achieved.

SUMMARY OF THE INVENTION

The present invention discloses a method and apparatus for polishing a wafer with a polishing pad that has a plurality of raised portions having a geometric center which is off-center with a center of the polishing pad.

The present invention discloses a polishing pad for polishing a semiconductor wafer comprising a plurality of raised portions having a geometric center and extending in a generally circumferential direction and wherein said geometric center is off-center with a center of the polishing pad.

The present invention discloses a method for polishing a semiconductor wafer comprising: providing a polishing pad with a plurality of raised portions having a geometric center off-center with a center of the polishing pad; and polishing the semiconductor wafer while constantly maintaining slurry underneath the wafer.

An advantage of the present invention is that it allows a single pad to be used when polishing.

An advantage of the present invention is that it is cheaper and gives improved uniformity.

DESCRIPTION OF THE PREFERRED EMBODIMENTS

Although certain preferred embodiments of the present invention will be shown and described in detail, it should be understood that various changes and modifications may be made without departing from the scope of the appended claims. The scope of the present invention will in no way be limited to the quantities of constituting components, the materials thereof, the shapes thereof, the relative arrangement thereof, etc., and are disclosed simply as an example of the embodiment.

Figure 1:
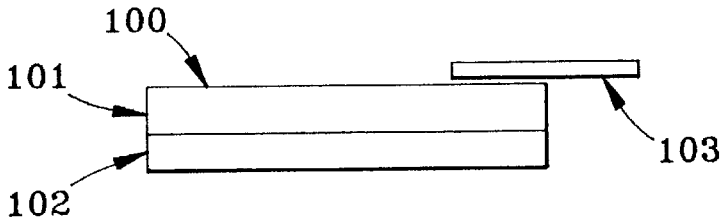
FIG. 1 PRIOR ART
FIG. 1 discloses a stacked pad configuration of the prior art.

Currently when polishing oxide surfaces a stacked pad combination must be used to prevent various problems. The stacked pad has a pad face 100 which is in contact with the wafer face 103. FIG. 1 shows a stacked pad face 100 in contact with the wafer face 103. The use of a stacked pad is very expensive and causes outer edge oxide thickness control issues. The stacked pad is made from a soft/sponge-like pad base 102 (such as a SUBA™ 4 pad) and a perforated, hard polyurethane top pad 101 (such as an IC1000™ pad). However, a single soft/sponge-like pad cannot be used because it is very compressible and gives poor within chip uniformity and causes local dishing of structures. Also, a single hard polyurethane pad cannot be used because the pad is non-compressible and causes a suction seal between the wafer and pad surface. The polish tool is then unable to break this seal and the tool has unload failures. Unload failures occur when the tool cannot pull away from the pad and, as a result, the wafer is ruined. The other reason for not being able to use a single hard polyurethane top pad is that the slurry is unable to get under the wafer surface uniformly, thus the center of the wafer gets under polished. The lack of slurry under the wafer surface causes within chip, or local, non-uniformity and across wafer, or global, non-uniformity. Non-uniformity of oxide thickness across the wafer surface can cause: over and under etch, residual metal and nitride, and overall poor electrical performance.

The actual mechanism occurring with a stacked pad is that the soft/sponge-like pad and the perforated hard polyurethane pad act like a slurry reservoir. When the wafer is pressed down into the stacked pad the soft/sponge-like pad compresses under the hard polyurethane pad and squeezes the slurry between the wafer surface and the polish surface of the hard polyurethane pad. The problem with this is the edge of the pad compresses more than the center of the pad, causing leading edge thickness variations. These variations lead to poor uniformity in the outer 15–20 mm of the wafer, which cause the same failure mechanism as described with a single pad.

Therefore, the industry is forced to live with the variations caused by single pads or the thick leading edge caused by the stacked pads. Any new type of pad improvement must address uniform slurry coverage under the wafer surface and prevent thick oxide on the leading outer edge of the wafer.

The solution of the present invention which prevents this non-uniformity caused by a single pad is to obtain enough slurry under the wafer surface, while preventing a suction seal from forming. The current grooving technology has always been to machine concentric rings in the pad "on center." This centered set of rings develops a pattern in the wafer that leads to poor global uniformity.

The present invention provides the grooves or channels "off center." This will produce a polishing surface that rotates off center from the wafer surface and will even out non-uniformity. This method has been evaluated and the results show an increase of overall uniformity of four times compared to that of the stacked pad configuration which is currently being used.

Figure 2:
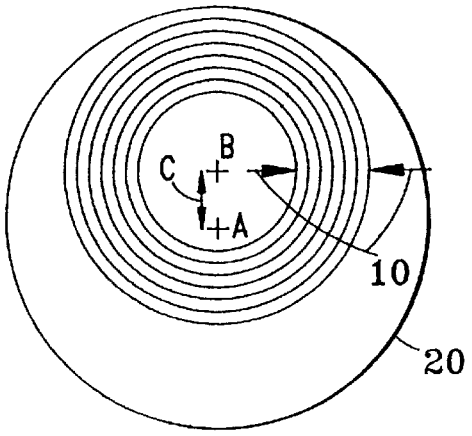
FIG. 2 discloses a top view of the present invention.

FIG. 2 shows an off-center pad 20 of the present invention. The geometric center of the pad 20 is labeled A and a series of circumferentially, concentric rings or channels which are grooved into the planar surface of the pad with a center located "off center" at point B. The grooved path area 10 is designed so that only full concentric rings are used to prevent any imprinting into the wafer surface during polishing.

It is critical in wafer polishing to get the slurry underneath the surface of the wafer when you push the wafer down into the pad surface. The grooves provide a slurry reservoir for the slurry to sit in. Therefore, when the wafer comes into contact it always has slurry. Whether using a single hard polishing pad or stacks of pads by making the grooves off center the pad of the present invention evens out the uniformity across the wafer and the uniformity of the remaining film on the wafer surface.

Figure 3:
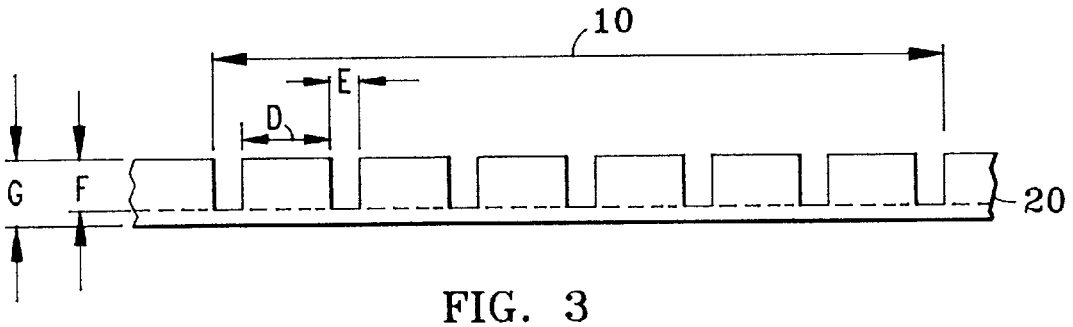
FIG. 3 discloses a cross-sectional view of the present invention.

FIG. 3 shows a side view of the polishing pad with the off center grooved path. The channels have a width E and depth F which is sufficient to allow slurry to channel beneath the substrate surface during polishing. The raised portions (or projecting portions) between the channels have a width D. The thickness of the pad is represent by G. For example purposes, when a 24 inch diameter pad was used, the thickness of the pad G was approximately 0.05 to 0.055 inches, the channel width E was approximately ⅛ of an inch, the depth of the channel was approximately 80% of the thickness of the pad or about 0.04 inches, and the raised portion D was approximately ⅜ of an inch wide. The off center distance C shown in FIG. 2 may range from 1.5 to 4 inches and ideally 1.5 inches.

An advantage of the present invention is that the current method of polishing with a groove on center can result in burning concentric patterns into the wafer. By placing the grooves off center, the path of the polishing is now going on an eccentric out path because the circles are not on center. By shifting the pattern off center the wafer is not hitting the same channel at all times. The channels are constantly changing underneath the wafer surface. Therefore, no pattern is polished into the surface. The result is actual uniformity across the wafer surface.

Another advantage of the present invention is that materials from different portions of the substrate can be removed at different rates to obtain a more uniform surface across the substrate.

Another advantage of the present invention is that the pad can be used without other underlying pads and yet still satisfies the need to get slurry underneath the face of the wafer. By being able to run with a single pad it makes a cheaper polishing operation.

Another advantage of the present invention is that it eliminates a phenomena called "wafer stickage" where cohesive forces between the face of the wafer and the actual smooth polishing pad form a suction. When suction is created it is very difficult to pull the wafer off the face. So by having grooved rings it provides a release so that the wafer can actually lift back off the polishing surface. The wafer does not get stuck because a little air is being let into the seal.

Another advantage of the present invention is that both global uniformity and local uniformity of polishing is achieved. Global uniformity is the distribution of thicknesses across the whole wafer surface. Local uniformity is the distribution of thicknesses within the chip box.

The examples provided above are used for illustrative purposes and it should be understood that different combinations of polishing pad, slurry, polishing carrier, and table size can be used depending on the film which is to be removed, the thickness profile prior to polishing and the desired final profile.

While the invention has been described in terms of its preferred embodiments, those skilled in the art will recognize that the invention can be practiced with modification within the spirit and scope of the appended claims.

What is claimed is:

1. A polishing pad for polishing a semiconductor comprising:

a pad face having a surface extending across a center of rotation; and a plurality of raised portions, on said pad face, sharing a common geometric center and extending in a generally circumferential direction, wherein said common geometric center is off-center with the center of rotation of the polishing pad.

2. The polishing pad of claim 1, further comprising a plurality of channels located between the plurality of raised portions.

3. The polishing pad of claim 2, wherein the depth of the plurality of channels is approximately 80% of the depth of the polishing pad.

4. The polishing pad of claim 2, wherein the plurality of channels are concentric rings.

5. The polishing pad of claim 1, wherein the geometric center is off-center from the center of the polishing pad in the range of 1.5 to 4 inches.

6. The polishing pad of claim 2, wherein the width of the raised portions is approximately ⅜ inches and the width of the channel is approximately ⅛ inches.

7. A polishing pad for polishing a semiconductor comprising:

a pad face having a surface extending across a center of rotation; and a plurality of grooves on said pad face, sharing a common geometric center and extending in a generally circumferential direction, wherein said common geometric center is off-center with the center of rotation of the polishing pad.

8. A polishing pad for polishing a semiconductor comprising:

a pad having a surface extending across a center of rotation; and a grooved path area comprising grooves arranged in concentric rings, the grooved path area being on said Pad face and having a geometric center and extending in a generally circumferential direction, wherein said geometric center is off-center with the center of rotation of the polishing pad.

9. The polishing pad of claim 8, wherein the depth of the plurality of grooves in the grooved path area are approximately 80% of the depth of the polishing pad.

10. The polishing pad of claim 8, wherein the geometric center is off-center from the center of the polishing pad in the range of 1.5 to 4 inches.

11. A method for polishing a semiconductor wafer comprising:

providing a polishing pad with a plurality of raised portions, wherein the plurality of raised portions share a common geometric center which is off-center with a center of the polishing pad;

attaching the polishing pad for rotation;

attaching a semiconductor wafer such that the semiconductor wafer has a center offset from said center of the polishing pad; and polishing the semiconductor wafer.

12. A method for polishing a semiconductor comprising:

providing a polishing pad with a plurality of raised portions having a geometric center off-center with a center of the polishing pad and a Plurality of channels located between the plurality of raised portions;

attaching only one said polishing pad for rotation; and polishing a semiconductor wafer.

* * * * *